US007398722B1

(12) United States Patent
Sims, Jr.

(10) Patent No.: US 7,398,722 B1
(45) Date of Patent: Jul. 15, 2008

(54) MULTIPLE POLE ELECTROMAGNETIC PROPULSION SYSTEM WITH SEPARATED BALLISTIC GUIDANCE AND ELECTRICAL CURRENT CONTACT SURFACES

(75) Inventor: James R. Sims, Jr., Los Alamos, NM (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 11/733,237

(22) Filed: Apr. 10, 2007

(51) Int. Cl.
*F41F 1/00* (2006.01)

(52) U.S. Cl. ..... 89/8; 124/3

(58) Field of Classification Search ..... 89/8, 89/27.11; 124/3; 42/501
See application file for complete search history.

(56) References Cited

U.S. PATENT DOCUMENTS 4,433,608 A * 2/1984 Deis et al. ..... 89/8
4,858,513 A * 8/1989 Kememy ..... 89/8
5,133,242 A * 7/1992 Witt ..... 89/8
5,431,083 A * 7/1995 Vassioukevitch ..... 89/8
5,856,630 A * 1/1999 Meger ..... 89/8

* cited by examiner

*Primary Examiner*—John W Eldred
(74) *Attorney, Agent, or Firm*—Thomas S. O'Dwyer; James C. Durkis; Paul A. Gottlieb

(57) ABSTRACT

An electromagnetic propulsion system is disclosed having separate rails for ballistic guidance and for carrying current. In this system, one or more pairs of ballistic guidance rails are provided, with each ballistic guidance rail having a pair of current carrying rails joined to it to form a combined rail. Each combined rail is separated electrically from adjacent combined rails by electrically insulating blocks. Each of the current carrying rails in a given combined rail pair have the same electrical polarity, and the polarities alternate between adjacent combined rails. Armatures contact current carrying rails to complete the circuit to generate the accelerating Lorentz force on the armatures. Bore riders on the sabot and/or projectile are in contact with the ballistic guide rails. Separation of the current carrying and ballistic guidance functions increases resistance of the system to rail movement and bending, as well as reduced wear/damage to the rails. In further embodiments, a circumferential over wrap providing compressive force on the rails further increases resistance of the system to rail movement and bending.

20 Claims, 9 Drawing Sheets

MULTIPLE POLE ELECTROMAGNETIC PROPULSION SYSTEM WITH SEPARATED BALLISTIC GUIDANCE AND ELECTRICAL CURRENT CONTACT SURFACES

STATEMENT REGARDING FEDERALLY SPONSORED RESEARCH OR DEVELOPMENT

The United States Government has rights in this invention pursuant to Contract No. DE-AC52-06NA25396 between the United States Department of Energy National Nuclear Security Administration and the Los Alamos National Security LLC for the operation of the Los Alamos National Laboratory.

BACKGROUND OF THE INVENTION

1) Field of the Invention

The present invention relates generally to electromagnetic propulsion systems, particularly to electromagnetic propulsions systems having separate ballistic guidance and electrical current contact surfaces, and more particularly to railguns having such separated ballistic guidance and current carrying functions.

2) Description of related art including information disclosed under 37 CFR 1.97 and 37 CFR 1.98

Electromagnetic propulsion systems, such as railguns, generally comprise at least one pair of conductive rails surrounding and disposed parallel to the longitudinal axis of a cavity. A power supply connected to the rails causes current to flow when an electrically conductive material (armature) disposed between the rails completes the circuit. The magnetic field formed around the rails applies a Lorentz force to the armature accelerating the armature along the cavity longitudinal axis. A projectile or other object attached to the armature can thus be accelerated and propelled. In addition to the force along the longitudinal axis, there is a lateral force (from the magnetic field) exerted on the rails which can increase the gap between the rails and the armature, possibly resulting in arcing with subsequent damage to the rails and insulator surfaces. The propulsive forces generated in such systems may be used in various kinds of launching systems, weapons systems, and transportation systems (propelling compartments containing animate and/or inanimate objects).

Unlike conventional chemical propellant burning guns, projective velocities in railguns are not limited by propellant gas sound speed. Further, the energy and velocity imparted to a launched projectile may be precisely achieved by controlling the voltage and current provided to the railgun.

Solid armature railguns, to date, have typically used the electrically contacting rail surfaces to also provide ballistic guidance to a projectile component (armature, projectile, and preferably a sabot) as they are propelled down the rails. Eventually, the rail wear becomes excessive and adversely affects the internal ballistics of the railgun. The deteriorated internal ballistic results in a loss of performance (velocity and accuracy): damage to the armature, sabot, and projectile; and further damage to the railgun interior. Plasma armatures are also known in the art, wherein the plasma results from a thin conductive material that is heated rapidly by the current passing through it. The rails, rail support structure, armature, and sabot must work together so that the plasma does not blow past the projectile.

U.S. Pat. No. 4,480,523 discloses an electromagnetic projectile launching system having a plurality of conductive rails distributed azimuthally on the inner surface of a barrel and a plurality of conductive armatures disposed between said conductive rails.

U.S. Pat. No. 5,078,042 discloses an electromagnetic railgun having four conducting rails in a quadra-pole configuration.

U.S. Pat. No. 5,285,763 discloses a railgun having four rails spaced equally and parallel to a predetermined axis of symmetry.

U.S. Pat. No. 5,454,289 discloses a railgun barrel having stacked metallic annular laminations in combination with pre-stressed tension elements to add radial and longitudinal stiffness.

U.S. Pat. No. 6,502,494 discloses a railgun accelerator system powered by alternating current using multiple railguns.

BRIEF SUMMARY OF THE INVENTION

In the present electromagnetic propulsion system (EMPS) invention the functions of rail ballistic guidance and electrical current contact are separated. Ballistic guidance is provided by one or more pairs of ballistic guidance rails. Two current carrying rails (CCR) of the same electrical polarity are joined to the sides of each ballistic guidance rail (BGR); (one CCR per side) to form a "combined rail". Each pair of CCRs alternates in electrical polarity between electrical positive and negative. The CCRs are preferably made from a material having high electrical conductivity, high tensile strength and inherent arcing damage resistance (exemplary materials including but not limited to: metal alloys such as aluminum oxide dispersion strengthened copper or composite materials combining copper and tungsten). The corners of the CCRs are preferably contoured to reduce current concentration effects. The BGRs are preferably made from materials having high electrical resistance, high tensile and compressive strength, high stiffness, and good surface wear characteristics. (exemplary materials including but not limited to: high strength alloy steels such as AISI 4140 or 4340, high strength stainless steels such as 316N, 21-6-9, and multi-phase super alloys such as MP35N). Preferably the ballistic guidance surface of the BGRs are treated to increase wear resistance and reduce friction, exemplary treatment methods including but not limited to heat treatment or vapor deposition processes. The CCRs are joined to the BGRs by means that preferably enhances the conduction of heat from the CCRs to the BGRs, exemplary means including but not limited to brazing, explosive bonding, diffusion bonding, and welded copper overlay. As needed, the combined rail would undergo a final machining operation to achieve desired rail profile and size.

The combined rails are arranged in even numbers around a common axis and are separated by electrically insulating blocks (EIBs), made from materials having high compressive strength, thermal shock resistance, and very high electrical resistance, exemplary materials include but not limited to: special compounded and produced partially stabilized Zirconia ceramic. Disposed in the interfaces between the combined rails and the insulating blocks are thin caskets (e.g. soft metal or creep resistant polymer) to level any geometric irregularities of the contacting surfaces, and provide a more uniform pressure distribution.

The entire array of combined rails are in electrical series connection; current flow occurs down all rails and across multiple armatures (preferably solid), simultaneously; said armatures being disposed in the spaces between adjacent combined rails and in contact with said combined rails. The armatures may be attached directly to the projectile, or preferably to a sabot which exerts a propelling force on the projectile. In one embodiment, the armatures are attached to arms projecting radially outward at the back of a sabot.

In a preferred embodiment, one or more bore riders (forward and rear) attached to the sabot or projectile slide down the BGRs, removing the majority of the ballistic guidance function away from the CCRs. Preferably the bore riders are plastic or composite (e.g. nylon, ultra-high molecular weight polyethylene, Teflon impregnated fiber reinforced structures, etc.). In a further embodiment, one or more of the BGRs contain passageway(s) for coolant (liquid or gas) to removed heat generated by current flowing in the CCRs and frictional heat generated by the bore riders sliding down the BGRs.

In a further embodiment, the combined rails are forced together with a very high compressive pre-load by means of a circumferential reinforcing over wrap of a ultra-high strength, high modulus fiber composite (exemplary materials including but not limited to PBO high modulus fiber (poly (p-phenylene-2,6-benzobisoxazole)), or other similar fibers). The fiber composite over wrap may be made by wet winding (using a suitable matrix resin) under high tension to obtain a 90% fiber fraction. Further, this winding process can occur at reduced temperatures (e.g. the assemblage could be cooled utilizing coolant passageways in the BGRs) to enable the assembly of combined rails, insulating blocks, fiber over wrap to become further pre-stressed as the parts warm to room or operating temperatures. The additional pre-stress arises from the negative thermal coefficient of expansion of the fiber; shrinking as it warms.

In a further embodiment, disposed between the fiber over wrap and the combined rails/insulating blocks is an environmental barrier to reduce the deleterious effects of light, humidity and electrical arc byproducts on the fiber over wrap. Preferably, the environmental barrier is a thin sleeve of material that is tough, flexible, conformable, a good electrical insulator, creep resistant under high compressive loads, and blocks moisture, gasses, visible and ultraviolet (UV) light from the bore. An exemplary material would be (but not limited to): a laminate of polyimide (Kapton) films reinforced with para-aramid (Kevlar) fibers; the innermost layer of polyimide film would include pigment(s) of inorganic, electrically insulating nature (e.g. titanium dioxide) to intercept the visible and UV light.

Outboard of the fiber over wrap is a casing (preferably metal or composite) to provide mechanical support and mounting features, and ballistic and environmental protection to the propulsion system internal components. The casing may have a round shell cross-section or, for reduced radar cross-section, may be made faceted with suitable internal filler blocks to support the fiber over wrap.

In a further embodiment, the interior bore may be evacuated to a low pressure (for improved high velocity operation) to eliminate or significantly reduce the problems of pushing a column of gas (such as air) ahead of a projectile/sabot being accelerated to supersonic velocity. In a preferred embodiment, the propulsion system comprises a firing chamber and a muzzle evacuation chamber. The electromagnetic (EM) propulsion of the projectile/sabot occurs in the firing chamber. Upon leaving the firing chamber, the projectile/sabot enters the muzzle evacuation chamber where the projectile/sabot continues to glide (by momentum) and is guided by ballistic guide rails. The muzzle evacuation chamber is preferably divided into a plurality of interior volumes by means of sequential plates and orifices (through which the sabot and projectile pass). Various means (e.g. high vacuum pumps) may be used to evacuate the volumes between the orifices, the firing chamber, and other interior bore volumes. The muzzle evacuation chamber will tend to reduce muzzle flash by pulling hot and hence radiating byproducts of armature arcing or any partial transition to a plasma or from a plasma armature into one or more pumping duct(s) fluidly connected to the interior bore. Reduced signature (due to reduced muzzle flash) is desirable in keeping the railgun or launcher system hidden (e.g. for military applications) and in reducing the impact of the flash on items located in the vicinity of the muzzle. In a preferred embodiment, the current carrying rails and insulating blocks do not extend beyond the firing chamber into the muzzle evacuation chamber. The ballistic guidance rails extend through the firing chamber and muzzle evacuation chamber. There is no significant further EM acceleration of the projectile/sabot once the armatures leave the current carrying rails and enter the muzzle evacuation chamber. Once the projectile/sabot leaves the muzzle evacuation chamber, the forward bore rider will petal into sections and fall behind the projectile as will the armature/sabot/rear bore rider due to aerodynamic drag.

BRIEF DESCRIPTION OF THE SEVERAL VIEWS OF THE DRAWING

In the figures, like or similar elements (such as 5, insulating block) utilize the same reference characters throughout the various views.

DETAILED DESCRIPTION OF THE INVENTION

Figure 1A:
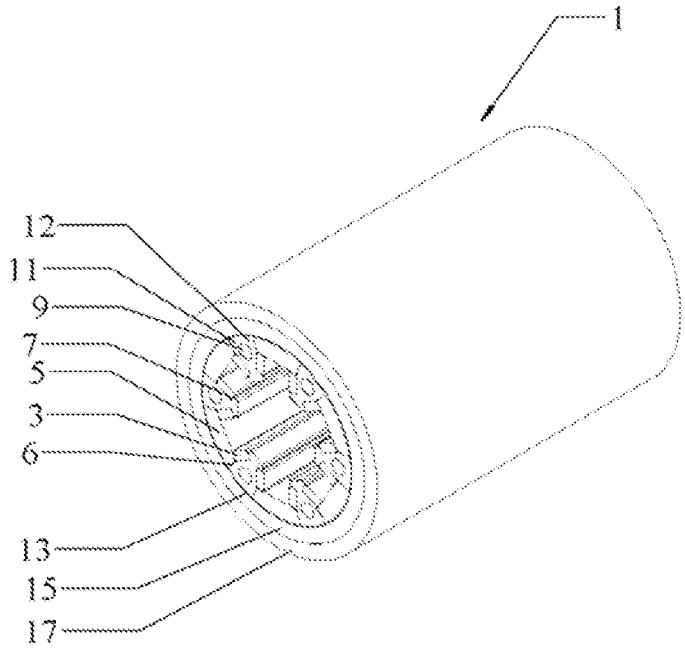
FIG. 1A provides an isometric view of an embodiment of the present invention comprising six combined rails.
Figure 1B:
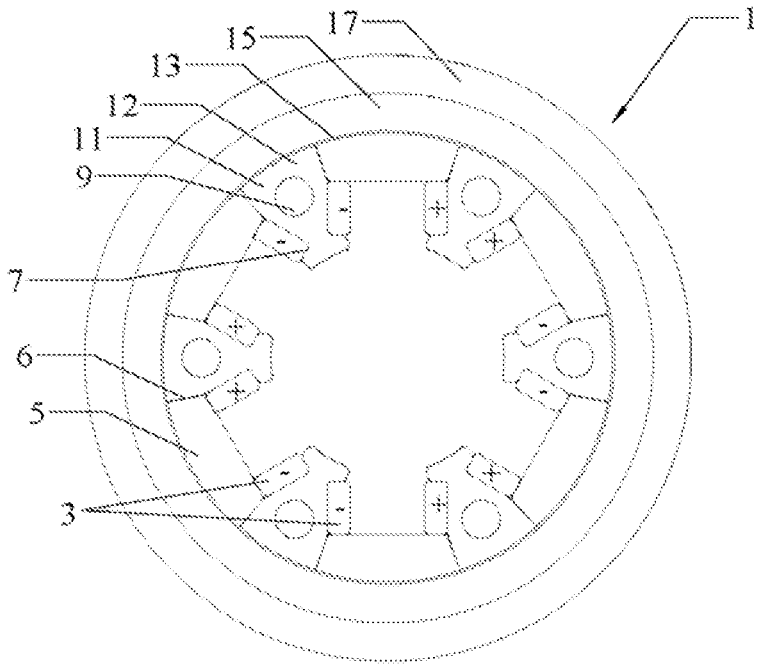
FIG. 1B provides a front view of the embodiment of FIG. 1A.
Figure 1C:
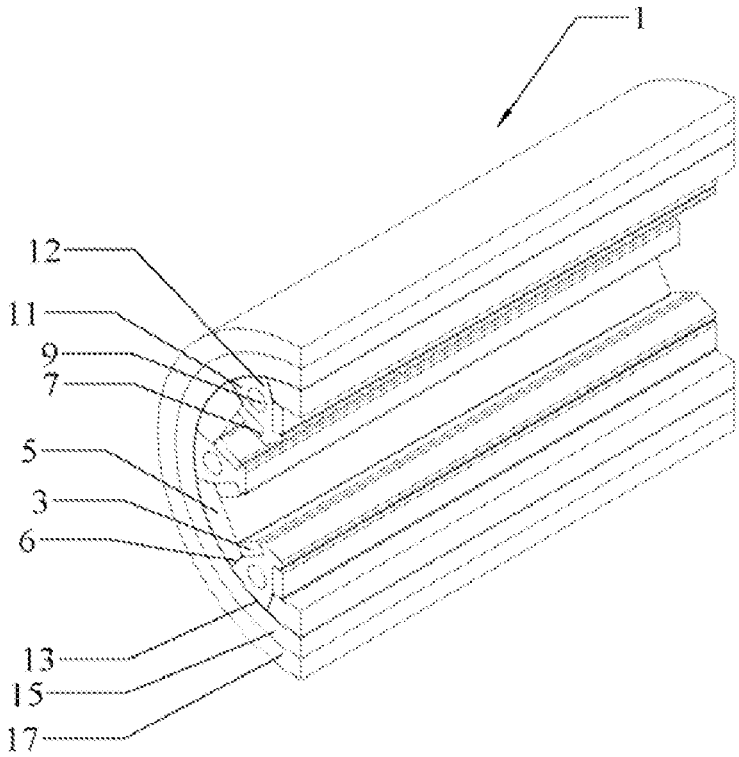
FIG. 1C provides an isometric section view of the embodiment of FIG. 1A.
Figure 2A:
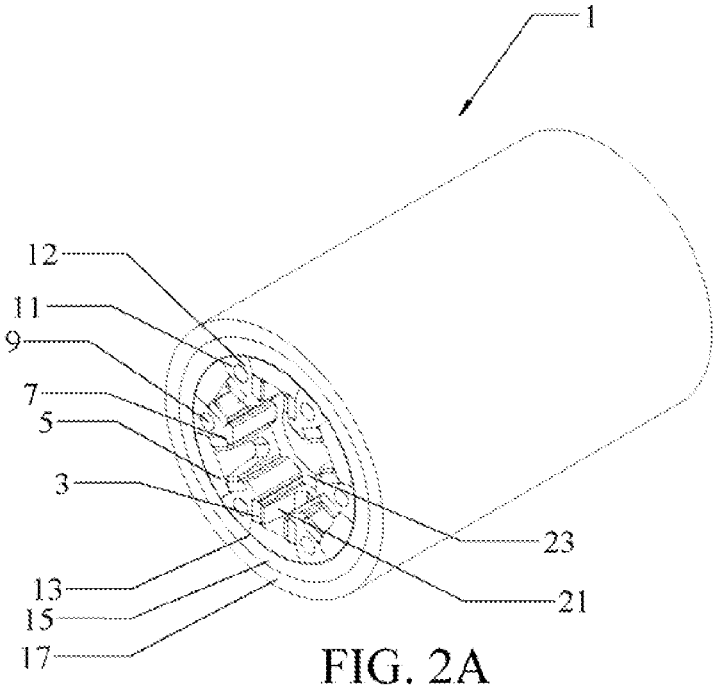
FIG. 2A provides an isometric view of the embodiment of FIG. 1A, and further illustrating interaction of the present invention with an exemplary armature/sabot/projectile component.
Figure 2B:
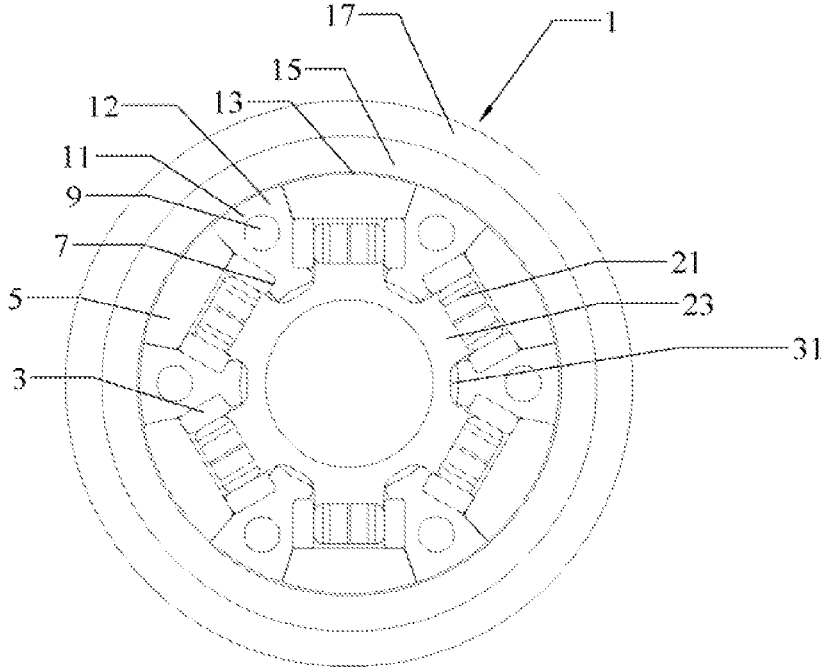
FIG. 2B provides a front view of the embodiment of FIG. 2A with the exemplary armature/sabot/projectile component.
Figure 2C:
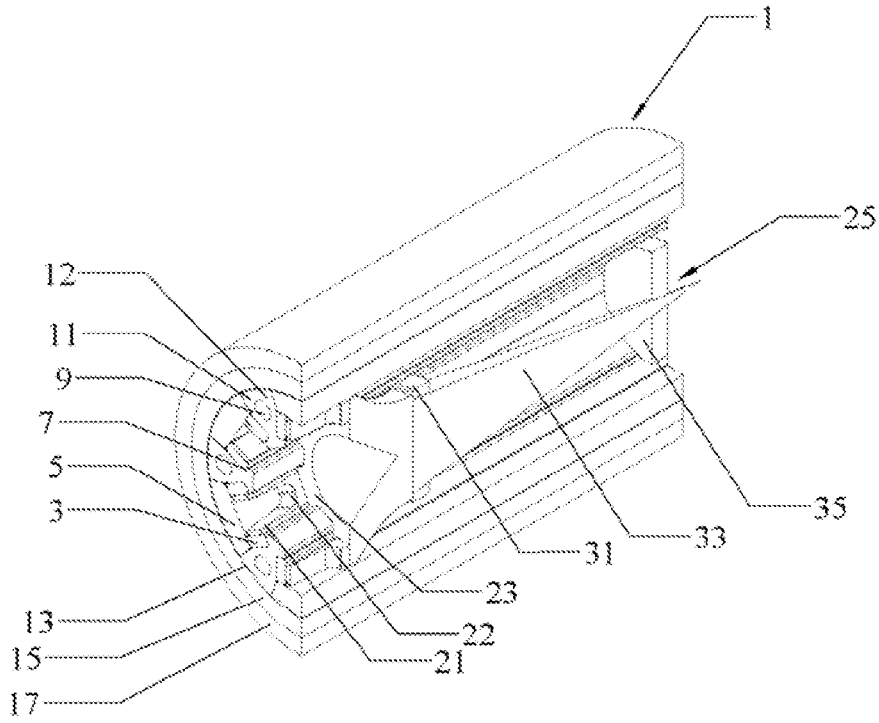
FIG. 2C provides an isometric section view of the embodiment of FIG. 2A with the exemplary armature/sabot/projectile component.

A first embodiment 1 according to the present invention, is described hereunder with reference to FIGS. 1A (isometric view), 1B (front view), and 1C (isometric section view). Ballistic guidance is provided by one or more pairs of ballistic guidance rails (BGRs) 11, in the FIG. 1 embodiment illustrated with three pairs of BGRs 11. Two current carrying rails (CCR) 3 (twelve shown) of the same electrical polarity are fixedly attached on two sides of each BGR 11; (one CCR 3 per side) to form a "combined rail" 12 (one BGR 11 and two CCRs 3). Each pair of CCRs 3 alternates in electrical polarity between electrical positive and negative. The CCRs 3 are preferably made from a material having high electrical conductivity, high tensile strength and inherent arcing damage resistance (exemplary materials including but not limited to: metal alloys such as aluminum oxide dispersion strengthened copper or composite materials combining copper and tungsten). The corners of the CCRs 3 are preferably contoured to reduce current concentration effects. The BGRs 11 are preferably made from materials having high electrical resistance, high tensile and compressive strength, high stiffness, and good surface wear characteristics. (exemplary materials including but not limited to: high strength alloy steels such as AISI 4140 or 4340, high strength stainless steels such as 316N, 21-6-9, and multi-phase super alloys such as MP35N). Preferably the ballistic guidance surface of the BGRs 11 are treated to increase wear resistance and reduce friction, exemplary treatment methods including but not limited to heat treatment or vapor deposition processes.

The CCRs 3 are fixedly attached to the BGRs 11 by a thermal conduction joint 7 (12 places in the illustrated embodiment) that enhances the conduction of heat from the CCRs 3 to the BGRs 11, the joint accomplished by exemplary means including but not limited to brazing, explosive bonding, diffusion bonding, and welded copper overlay. As needed, the combined rail 12 would undergo a final machining operation to achieve desired rail profile and size.

The combined rails 12 are arranged in even numbers (minimum two, preferably six, eight, or ten) around a common axis. Increasing the number of combined rails 12 brings certain advantages (increased propulsive force) and disadvantages (increased parts count, complexity: more rail electrical connections, ballistic rail coolant plumbing, increased armature contact losses, and less favorable magnetic field volume to overall assembly volume ratio for a given cross section).

The combined rails 12 are separated by electrically insulating blocks (EIBs) 5 (six shown), made from materials having high compressive strength, thermal shock resistance, and very high electrical resistance, exemplary materials include but not limited to: special compounded and produced partially stabilized Zirconia ceramic.

Disposed in the interfaces between the combined rails 12 and the insulating blocks 5 are thin gaskets 6 (twelve shown) (e.g. soft metal or creep resistant polymer) to level any geometric irregularities of the contacting surfaces, and provide a more uniform pressure distribution.

Referring to FIGS. 2A-2C, 3A, 3B, illustrating interaction of the propulsion system 1 with an armature/sabot/projectile component 25, the entire array of combined rails 12 are in electrical series connection; current flow occurs down all combined rails 12 and across multiple armatures 21 (preferably solid), simultaneously; said armatures 21 being disposed in the spaces between adjacent combined rails 12 and in contact with said combined rails 12. The armatures 21 may be attached directly to the projectile 33, or preferably to a sabot 23 which exerts a propelling force on the projectile 33. In one embodiment, the armatures 21 are attached to arms 22 projecting radially outward at the back of sabot 23.

Besides the solid armatures shown in the embodiments, plasma armatures may also be used (not shown). In such embodiments, the solid armatures would be replaced with smaller "fuse type" solid armatures which would pass current between the combined rails but would almost immediately arc and transition to a plasma state. In conventional electromagnetic propulsions systems, including railguns, plasma armatures tend to burn material off the rails and insulators, causing damage, and adding parasitic mass (which the propulsion system must also accelerate) to the plasma "cloud" behind the sabot. In the instant invention, separation of the ballistic guide and current carrying functions reduces the potential deleterious effects of the plasma since the bore riders run on ballistic guidance rails formed from materials more resistant to damage. In addition, the electrically insulating blocks may be formed from ceramics which are resistant to carbonizing in the presence of the plasma; reducing the potential for shorting between the rails.

In a preferred embodiment, one or more bore riders (forward 35 and rear 31) attached to the sabot 23 or projectile 33 slide down the BGRs 11, removing the majority of the ballistic guidance function away from the CCRs 3. Preferably the bore riders (31 and 35) are plastic or composite (e.g. nylon, ultra-high molecular weight polyethylene, Teflon impregnated fiber reinforced structures, etc.). In a further embodiment, one or more of the BGRs 11 contain passageway(s) (six shown) 9 for coolant (liquid or gas) to removed heat generated by current flowing in the CCRs 3 and frictional heat generated by the bore riders (31 and 35) sliding down the BGRs 11.

In a further embodiment, the combined rails are forced together with a very high compressive pre-load by means of a circumferential reinforcing over wrap 15 of a ultra-high strength, high modulus fiber composite (exemplary materials including but not limited to PBO high modulus fiber (poly (p-phenylene-2,6-benzobisoxazole)), or other similar fibers. The fiber composite over wrap 15 may be made by wet winding (using a suitable matrix resin) under high tension to obtain a 90% fiber fraction. Further, this winding process can occur at reduced temperatures (e.g. the assemblage could be cooled utilizing coolant passageways 9 in the BGRs 11) to enable the assembly of combined rails, insulating blocks, fiber over wrap to become further pre-stressed as the parts warm to room or operating temperatures. The additional prestress arises from the negative thermal coefficient of expansion of the fiber; shrinking as it warms.

In a further embodiment, disposed between the fiber over wrap 15 and the combined rails 12/insulating blocks 5 is an environmental barrier 13 to reduce the deleterious effects of light, humidity and electrical arc byproducts on the fiber over wrap 15. Preferably, the environmental barrier 13 is a thin sleeve of material that is tough, flexible, conformable, a good electrical insulator, creep resistant under high compressive loads, and blocks moisture, gasses, visible and ultraviolet (UV) light from the bore. An exemplary material would be (but not limited to): a laminate of polyimide (Kapton) films reinforced with para-aramid (Kevlar) fibers; the innermost layer of polyimide film would include pigment(s) of inorganic, electrically insulating nature (e.g. titanium dioxide) to intercept the visible and UV light.

Outboard of the fiber over wrap is a casing 17 (preferably metal or composite) to provide mechanical support and mounting features, and ballistic and environmental protection to the propulsion system internal components. The casing 17 may have a round shell cross-section or, for reduced radar cross-section, may be made faceted with suitable internal filler blocks to support the fiber over wrap. Circular or many sided polygon shapes are preferred for the outer portion to reduce the bending stresses in the outer reinforcing shell. However, any outer shape could be used provided sufficiently strong material is used for the performance level desired.

A circular or near circular bore for the ballistic rails' projectile contact surface geometry are preferred from a manufacturing and maintenance standpoint, but other bore cross sections may be used.

Figure 3A:
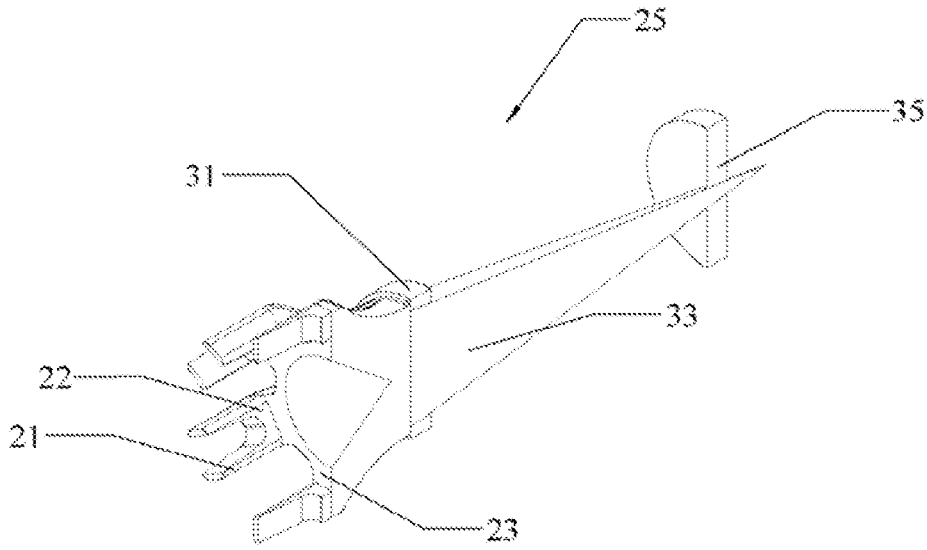
FIG. 3A provides an isometric section view of the exemplary armature/sabot/projectile component.
Figure 3B:
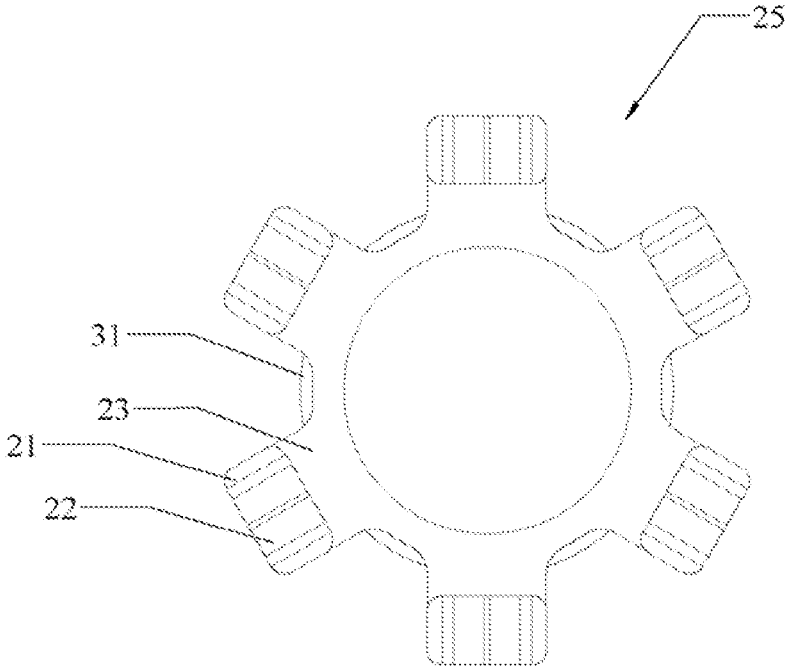
FIG. 3B provides a front view of the exemplary armature/sabot/projectile component.
Figure 4A:
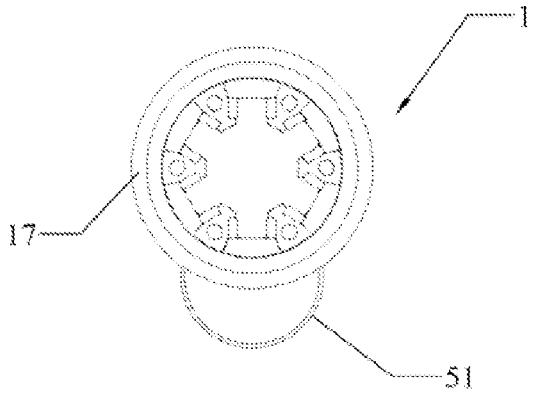
FIG. 4A provides a breech end view of an embodiment with a partially evacuated inner bore.
Figure 4B:
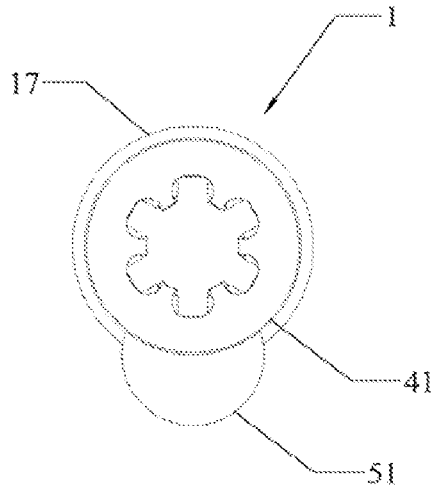
FIG. 4B provides a muzzle end view of the embodiment of FIG. 4A.
Figure 4C:
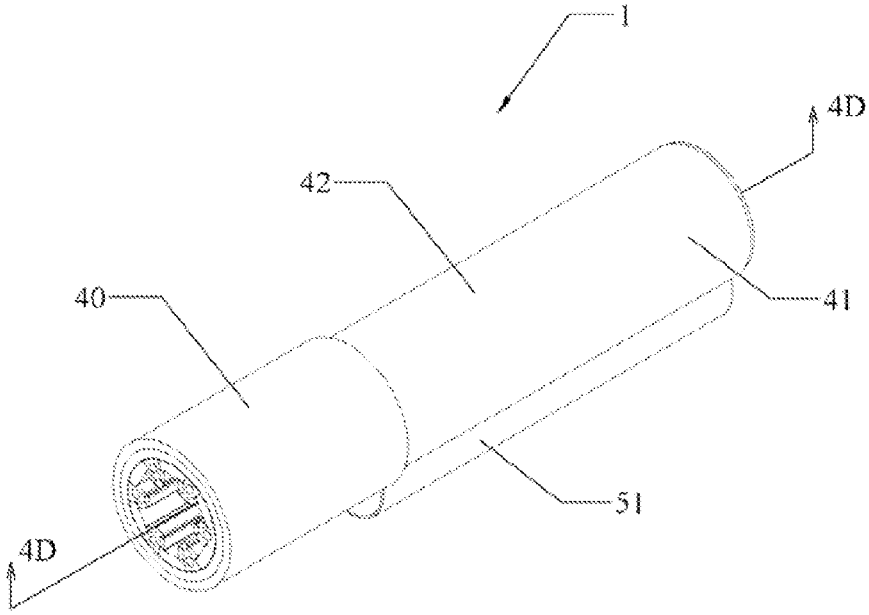
FIG. 4C provides an isometric view of the embodiment of FIG. 4A.
Figure 4D:
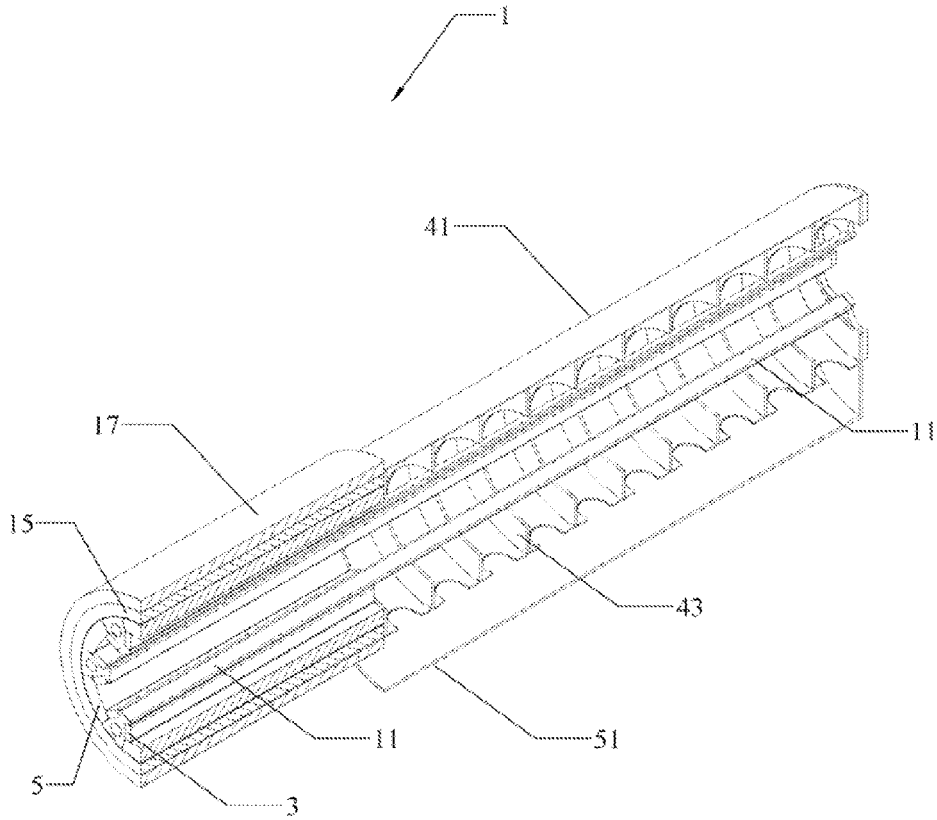
FIG. 4D provides an isometric section view of the embodiment of FIG. 4A.
Figure 5A:
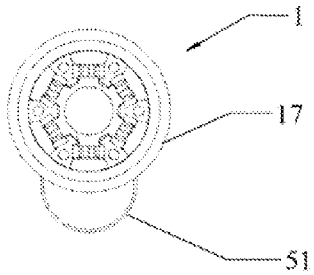
FIG. 5A provides a breech end view of the embodiment of FIG. 4A, and further illustrating interaction of the present invention with an exemplary armature/sabot/projectile component.
Figure 5B:
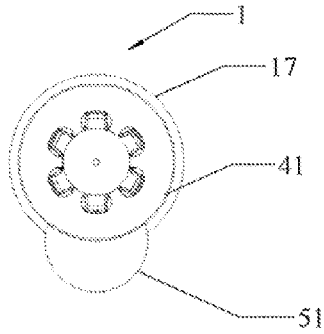
FIG. 5B provides a muzzle end view of the embodiment of FIG. 5A.
Figure 5C:
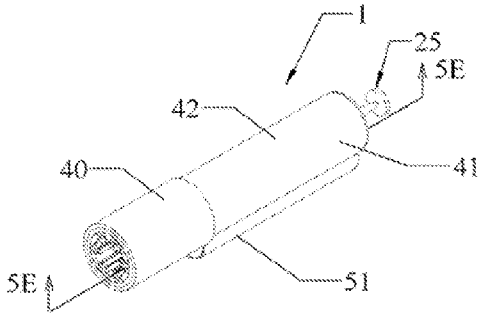
FIG. 5C provides an isometric view of the embodiment of FIG. 5A, view angle from the breech end.
Figure 5D:
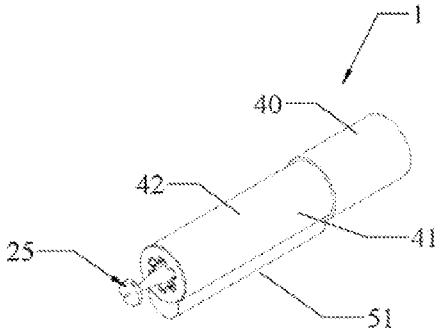
FIG. 5D provides an isometric view of the embodiment of FIG. 5A, view angle from the muzzle end.
Figure 5E:
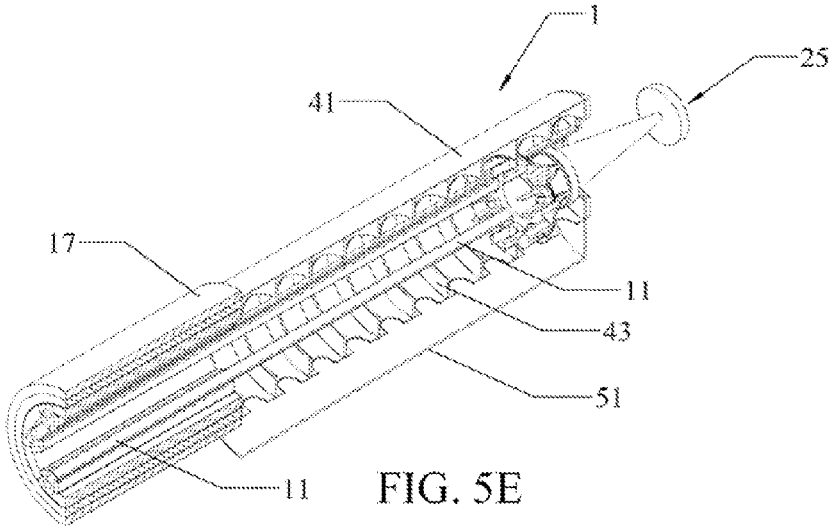
FIG. 5E provides an isometric section view of the embodiment of FIG. 5A.
Figure 5F:
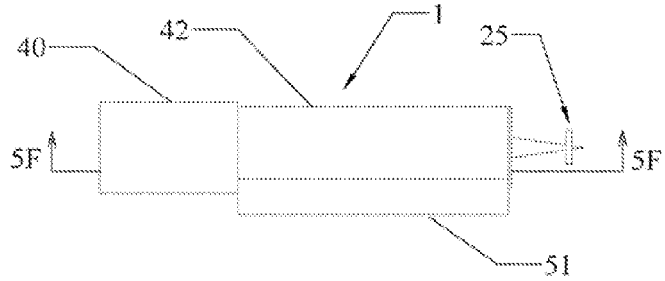
FIG. 5F provides a side view of the embodiment of FIG. 5A.
Figure 5G:
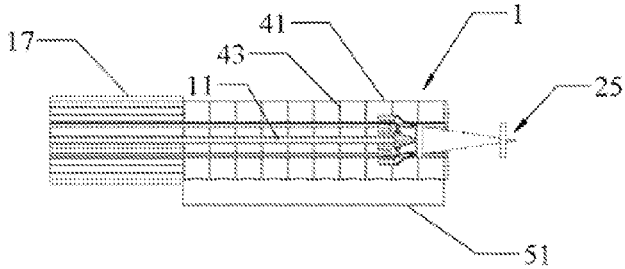
FIG. 5G provides a side section view of the embodiment of FIG. 5A.

In a further embodiment, the interior bore space may be evacuated to a low pressure (for improved high velocity operation) to eliminate or significantly reduce the problems of pushing a column of gas (such as air) ahead of a projectile/sabot being accelerated to supersonic velocity. Referring to FIGS. 4A-C, 5A-G, in a preferred embodiment, the propulsion system 1 comprises a firing chamber (FC) 40 and a muzzle evacuation chamber (MEC) 42. The electromagnetic (EM) propulsion of the projectile/sabot component 25 occurs in the firing chamber 40. Upon leaving the firing chamber 40, the projectile/sabot component 25 enters the muzzle evacuation chamber 42 where the projectile/sabot 25 continues to glide (by momentum) on and guided by ballistic guide rails 11. The internal bore space for firing chamber 40 is defined by a first enclosure (such as fiber over wrap 15 or casing 17). The internal bore space for the muzzle evacuation chamber 42 is defined by a second enclosure 41. Enclosure 41 may be an extension of fiber over wrap 15, an extension of casing 17, or a separate element. The muzzle evacuation chamber 42 is preferably divided into a plurality of interior volumes by means of sequential plates 43 and orifices (through which the projectile/sabot component 25 passes). Various means (such as high vacuum pumps (not shown)) may be used to evacuate the volumes between the orifices, the firing chamber, and other interior bore volumes. The muzzle evacuation chamber 42 will tend to reduce muzzle flash by pulling hot and hence radiating byproducts of armature arcing, any partial transition to a plasma, or from a plasma armature into one or more pumping duct(s) 51 fluidly connected to the interior bore. Reduced signature (due to reduced muzzle flash) is desirable in keeping the railgun or launcher system hidden (e.g. for military applications) and in reducing the impact of the flash on items located in the vicinity of the muzzle. In a preferred embodiment, the current carrying rails 3 and insulating blocks 5 do not extend beyond the firing chamber 40 into the muzzle evacuation chamber 42. The ballistic guidance rails 11 extend through the firing chamber 40 and muzzle evacuation chamber 42. There is no significant further EM acceleration of the projectile/sabot component 25 once the armatures leave the current carrying rails 3 and enter the muzzle evacuation chamber 42. Referring to FIGS. 3A and 5E, once the projectile/sabot component 25 leaves the muzzle evacuation chamber 42, the forward bore rider 35 will petal into sections and fall behind the projectile 33 as will the armature 21, sabot 23, and rear bore rider 31 due to aerodynamic drag. Covering 41, orifice plates 43, and pumping duct(s) 51 is preferably comprised of materials having high strength, high fracture toughness, high electrical resistivity, economical in cost, and ease of fabrication, preferably carbon steel or stainless steel, including but not limited to AISI C1018 Carbon steel or UNS30400 stainless steel.

Appropriate volume is provided for the ready propagation of magnetic fields by maintaining empty volumes and volumes filled with non-conducting, non-magnetic structural material (e.g. the electrical insulating blocks, environmental barrier, fiber over wrap). These spaces allow better propagation of the magnetic field around the rails and through the armature volumes, and improve performance by permitting more inductance gradient.

In the instant invention, the use of multiple rails with separated ballistic and current carrying functions provides numerous advantages over prior railgun/EM propulsion systems: a) better distributed structural loading (less bending of the rails) due to bending forces on the current carrying rails being shared by the ballistic guidance rails; b) less dependence upon current carrying rails for ballistic guidance; c) less ballistic wear on the current carrying rails due to the bore riders riding on the ballistic guidance rails; d) fewer electrical insulation problems. The arrangement of conductors, non-conductors (dielectrics), and empty volume provides for an induction gradient for efficient operation. Coolant channels provided enable rapid repetition rate of operation. Evacuation of the bore to a low pressure enables improved high velocity operation.

Obviously numerous modifications and variations of the present invention are possible in the light of the above teachings. It is therefore to be understood that within the scope of the appended claims the invention may be practiced otherwise than as specifically described therein.

I claim:

1. An electromagnetic propulsion system for use with an electrical power source to propel a projectile component, the propulsion system comprising:

a) at least one pair of generally parallel ballistic guidance rails, spaced circumferentially apart from each other;

b) a pair of current carrying rails joined to each ballistic guidance rail to form a combined rail, and aligned generally parallel to the ballistic guidance rail that they are joined to, with the current carrying rails connected to said power supply and wired in series electrically so that, both current carrying rails for a given ballistic guidance rail have the same electrical polarity, and each pair of current carrying rails alternate in electric polarity with the adjacent pair of current carrying rails, c) an electrically insulating block disposed in the circumferential spaces between every two adjacent combined rails, said combined rails and electrically insulating blocks in total defining an interior bore space within which said projectile component is disposed;

d) wherein said projectile component comprises a projectile and two or more armatures, with an armature disposed in each circumferential space defined by each said electrically insulating block and its two adjacent combined rails, each said armature making contact with a positive polarity current carrying rail and a negative polarity current carrying rail, thereby completing the electric circuit and allowing current to flow in said armatures and current carrying rails, said flowing current generating a magnetic field around each current carrying rail which creates a Lorentz force that acts on said armatures propelling said armatures in a direction parallel to said current carrying rails; and e) wherein said armatures interact with said projectile wherein propulsion of said armatures causes said projectile to be propelled as well.

2. The electromagnetic propulsion system according to claim 1 wherein:

said projectile component comprises said armatures being joined to a sabot, which in turn is joined to said projectile.

3. The electromagnetic propulsion system according to claim 1 wherein:

said projectile component further comprises one or more bore riders which contact the surfaces of said ballistic guidance rails as said projectile component traverses the bore.

4. The electromagnetic propulsion system according to claim 1 wherein:

said joints between said current carrying rails and said ballistic guidance rails enhance the conduction of thermal energy from said current carrying rails to said ballistic guidance rails.

5. The electromagnetic propulsion system according to claim 1 wherein:

one or more of said ballistic guidance rails have passageways capable of receiving cooling fluid for the purpose of removing thermal energy resident in said ballistic guidance rails.

6. The electromagnetic propulsion system according to claim 1 further comprising:

a thin gasket disposed between each electrically insulating block and each of its adjacent combined rails.

7. The electromagnetic propulsion system according to claim 1 further comprising:

an outer casing surrounding said electrically insulating blocks and combined rails.

8. The electromagnetic propulsion system according to claim 7 further comprising:

a circumferential reinforcing over wrap disposed between said outer casing and said electrically insulating blocks and combined rails, serving to exert a compressive load on said blocks and rails to resist bending and other movements of said blocks and rails.

9. The electromagnetic propulsion system according to claim 8 further comprising:

an environmental barrier disposed between said over wrap and said electrically insulating blocks and combined rails.

10. The electromagnetic propulsion system according to claim 1 wherein:

said system is a railgun; and said projectile is suitable for use in weapons systems.

11. The electromagnetic propulsion system according to claim 1 wherein:

said system is a transportation system; and said projectile is a compartment capable of containing animate and/or inanimate objects.

12. The electromagnetic propulsion system according to claim 1 wherein:

said system is a system used to launch objects.

13. The electromagnetic propulsion system according to claim 1 further comprising:

a) a first enclosure to define an internal space for a firing chamber (FC), said first enclosure surrounding said current carrying rails, electrically insulating blocks, and ballistic guidance rails;

b) a second enclosure to define an internal space for a muzzle evacuation chamber (MEC), said MEC internal space in fluid communication with said FC internal space, and said ballistic guidance rails extending from said firing chamber through said muzzle evacuation chamber;

c) one or more orifice plates disposed along the longitudinal axis of said MEC internal space to divide said MEC internal space into a series of volumes, said orifices sized to permit passage of said projectile component therethrough;

d) at least one pumping duct in fluid communication with said MEC internal space; and e) means for evacuating said FC and MEC internal spaces via said pumping duct.

14. An electromagnetic propulsion system railgun for use with an electrical power source to propel a projectile component, the propulsion system comprising:

a) at least one pair of generally parallel ballistic guidance rails, spaced circumferentially apart from each other;

b) a pair of current carrying rails joined to each ballistic guidance rail to form a combined rail, and aligned generally parallel to the ballistic guidance rail that they are joined to, with the current carrying rails connected to said power supply and wired in series electrically so that, both current carrying rails for a given ballistic guidance rail have the same electrical polarity, and each pair of current carrying rails alternate in electric polarity with the adjacent pair of current carrying rails, c) an electrically insulating block disposed in the circumferential spaces between every two adjacent combined rails, said combined rails and electrically insulating blocks in total defining an interior bore space within which said projectile component is disposed;

d) a thin gasket disposed between each electrically insulating block and each of its adjacent combined rails;

e) an outer casing outboard of and surrounding said electrically insulating blocks and combined rails;

f) a circumferential reinforcing over wrap disposed between said outer casing and said electrically insulating blocks and combined rails, serving to exert a compressive load on said blocks and rails to resist bending and other movements of said blocks and rails;

g) an environmental barrier disposed between said over wrap and said electrically insulating blocks and combined rails;

h) wherein said joints between said current carrying rails and said ballistic guidance rails enhance the conduction of thermal energy from said current carrying rails to said ballistic guidance rails, and one or more of said ballistic guidance rails have passageways capable of receiving cooling fluid for the purpose of removing thermal energy resident in said ballistic guidance rails;

i) wherein said projectile component comprises a projectile and two or more armatures, with an armature disposed in each circumferential space defined by each said electrically insulating block and its two adjacent combined rails, each said armature making contact with a positive polarity current carrying rail and a negative polarity current carrying rail, thereby completing the electric circuit and allowing current to flow in said armatures and current carrying rails, said flowing current generating a magnetic field around each current carrying rail which creates a Lorentz force that acts on said armatures propelling said armatures in a direction parallel to said current carrying rails; and j) wherein said armatures interact with said projectile wherein propulsion of said armatures causes said projectile to be propelled as well.

15. The electromagnetic propulsion system according to claim 14 wherein:

said projectile component further comprises a sabot, with said armatures being joined to said sabot, and said sabot joined to said projectile.

16. The electromagnetic propulsion system according to claim 15 wherein:

said projectile component further comprises one or more bore riders which contact and ride on the surfaces of said ballistic guidance rails as said projectile component traverses said bore.

17. The electromagnetic propulsion system according to claim 15 further comprising:

a) a first enclosure to define an internal space for a firing chamber (FC), said first enclosure surrounding said current carrying rails, electrically insulating blocks, and ballistic guidance rails;

b) a second enclosure to define an internal space for a muzzle evacuation chamber (MEC), said MEC internal space in fluid communication with said FC internal space, and said ballistic guidance rails extending from said firing chamber through said muzzle evacuation chamber;

c) one or more orifice plates disposed along the longitudinal axis of said MEC internal space to divide said MEC internal space into a series of volumes, said orifices sized to permit passage of said projectile component therethrough;

d) at least one pumping duct in fluid communication with said MEC internal space; and e) means for evacuating said FC and MEC internal spaces via said pumping duct.

18. A railgun for use with an electrical power source to propel a projectile component, the railgun comprising:

a) at least one pair of generally parallel ballistic guidance rails, spaced circumferentially apart from each other;

b) a pair of current carrying rails joined to each ballistic guidance rail to form a combined rail, and aligned generally parallel to the ballistic guidance rail that they are joined to, with the current carrying rails connected to said power supply and wired in series electrically so that, both current carrying rails for a given ballistic guidance rail have the same electrical polarity, and each pair of current carrying rails alternate in electric polarity with the adjacent pair of current carrying rails;

c) an electrically insulating block disposed in the circumferential spaces between every two adjacent combined rails, said combined rails and electrically insulating blocks in total defining an interior bore space within which said projectile component is disposed;

d) a thin gasket disposed between each electrically insulating block and each of its adjacent combined rails, e) an outer casing outboard of and surrounding said electrically insulating blocks and combined rails;

f) a circumferential reinforcing over wrap disposed between said outer casing and said electrically insulating blocks and combined rails, serving to exert a compressive load on said blocks and rails to resist bending and other movements of said blocks and rails;

g) an environmental barrier disposed between said over wrap and said electrically insulating blocks and combined rails;

h) and wherein said joints between said current carrying rails and said ballistic guidance rails enhance the conduction of thermal energy from said current carrying rails to said ballistic guidance rails, and one or more of said ballistic guidance rails have passageways capable of receiving cooling fluid for the purpose of removing thermal energy resident in said ballistic guidance rails;

i) wherein said projectile component comprises a projectile, and two or more armatures, with an armature disposed in each circumferential space defined by each said electrically insulating block and its two adjacent combined rails, each said armature making contact with a positive polarity current carrying rail and a negative polarity current carrying rail, thereby completing the electric circuit with said power supply and allowing current to flow in said armatures and current carrying rails, said flowing current generating a magnetic field around each current carrying rail which creates a Lorentz force that acts on said armatures propelling said armatures in a direction parallel to said current carrying rails, and said bore rider being in contact with said ballistic guidance rails as said projectile component traverses the bore;

j) and wherein said armatures interact with said projectile wherein propulsion of said armatures causes said projectile to be propelled as well.

19. The railgun system according to claim 18 wherein:

said projectile component further comprises a sabot, with said armatures being joined to said sabot, and said sabot joined to said projectile, and one or more bore riders which contact and ride on the surfaces of said ballistic guidance rails as said projectile component traverses said bore.

20. The railgun system according to claim 18 further comprising:

a) a first enclosure to define an internal space for a firing chamber (FC), said first enclosure surrounding said current carrying rails, electrically insulating blocks, and ballistic guidance rails, b) a second enclosure to define an internal space for a muzzle evacuation chamber (MEC), said MEC internal space in fluid communication with said FC internal space, and said ballistic guidance rails extending from said firing chamber through said muzzle evacuation chamber;

c) one or more orifice plates disposed along the longitudinal axis of said MEC internal space to divide said MEC internal space into a series of volumes, said orifices sized to permit passage of said projectile component therethrough;

d) at least one pumping duct in fluid communication with said MEC internal space; and e) means for evacuating said FC and MEC internal spaces via said pumping duct.

* * * * *